United States Patent [19]

Cariteau et al.

[11] Patent Number: 4,706,423

[45] Date of Patent: Nov. 17, 1987

[54] STRUCTURE FOR AN IN-GROUND STORAGE BIN FACILITY, AND METHOD OF MANUFACTURING IT

[75] Inventors: Bernard Cariteau, Sarlat; Jean-Pierre Legros, Domme; André Charrieras, Brive; Michel Feuvrier, La Pace, all of France

[73] Assignee: Mega X Protection, France

[21] Appl. No.: 856,229

[22] Filed: Apr. 28, 1986

[51] Int. Cl.[4] ..... E02D 27/00

[52] U.S. Cl. ..... 52/169.7; 52/19; 52/20

[58] Field of Search ..... 52/169.7, 19, 20, 21, 52/182, 187, 36, 169.9, 169.11

[56] References Cited

U.S. PATENT DOCUMENTS 3,618,275 11/1967 Ance ..... 52/19 X
4,226,062 10/1980 Doane .
4,231,201 11/1980 Harnois ..... 52/20 X

*Primary Examiner*—William F. Pate, III
*Assistant Examiner*—Creighton Smith
*Attorney, Agent, or Firm*—Gerald J. Ferguson, Jr.; Michael P. Hoffman; Michael J. Foycik

[57] ABSTRACT

The structure comprises a main wall (1) having bins (2) projecting therefrom. The bins are separated by gaps (b 5, 8) and projects outwardly from an installed storage facility, such that each bins is completely surrounded by earth on five of its six faces. The wall (1) is made as a generally flat tray-like structure for storage and transport purposes, which structure is curved prior to being installed in a suitable hole.

9 Claims, 3 Drawing Figures

STRUCTURE FOR AN IN-GROUND STORAGE BIN FACILITY, AND METHOD OF MANUFACTURING IT

The invention relates to a structure designed for rapidly implementing a storage bin facility in the ground, suitable for use as a wine cellar, for example.

BACKGROUND OF THE INVENTION

European published patent specification No. EP-$B_2$-002141 describes an in-ground storage facility which is made on site using prefabricated elements which are essentially constituted by concrete bins. Each bin has a far wall and three side walls. The bins are laid against one another in successive courses like bricks in a previously dug cylindrical hole, thereby building a circular wall around a central spiral staircase. In an in-ground facility designed in this way, the far walls of the bins constitute the outer wall of the facility itself, and the bins are on the inside relative to said wall.

The main aim of the present invention is to provide a structure for an in-ground storage bin facility in which the bins are spaced apart from one another with each bin being surrounded by earth on at least three of its faces, and may be surrounded on five of its faces, with an open access face being inwardly directed towards the inside of the facility.

A secondary aim of the invention is to provide a structure of the above-defined type which is designed in such a manner as to be capable of being prefabricated in a workshop or factory, of being stored and transported easily, and finally of being rapidly installed on site in a hole that has been dug to receive it.

SUMMARY OF THE INVENTION

An in-ground storage bin facility in accordance with the present invention has a wall referred to as the "main" wall which extends around a closed perimeter about a vertical longitudinal axis, together with bins which project outwardly from said main wall, with each bin having an opening in said main wall, said bins being spaced apart from one another at least in planes transverse to said longitudinal axis.

In one embodiment of the invention, grooves are provided in at least the two facing vertical side walls of each bin in order to slideably receive bin-partitioning walls by sliding.

In a variant embodiment, the bins run together and constitute outwardly projecting columns extending parallel to the longitudinal axis and spaced apart from one another, with partitions being inserted in the grooves to delimit the bins in the vertical direction.

In a preferred embodiment, the bins are spaced apart from one another in the longitudinal direction of the column, thereby making each bin independent from the neighbouring bins, such that each bin projects individually outwardly from the main wall and when the structure is in the ground, each bin is surrounded by ground on all of its faces other than its face which opens inwardly into the inside of the storage facility through the main wall.

In a structure installed in the ground, there is a central pole with a spiral of staircase steps projecting radially therefrom, with the steps being fixed to the central pole and extending outwardly to come into contact with the inside face of the main wall. The circumferential extent of the free ends of the steps is greater than the corresponding extent of the bins.

The invention also relates to a method of manufacturing the above-defined structure. According to the method, the structure is made from flexible material in the form of a generally flat tray and is transported in the flat condition, being looped on site around a perimeter which is preferably circular but which is not necessarily circular, with two meeting ends of the structure being firmly interconnected.

Advantageously, the structure is made in layers which are superposed to obtain the total desired height for the in-ground facility, and to this end complementary assembly means are provided along the superposable edges of the structure.

In one embodiment of the invention, each bin has a cross-sectional area at its far end from the main wall which is smaller than its cross-sectional area at its opening through the main wall, the resulting taper may be sufficiently marked for it to be possible to stack said generally flat tray-like structures with the bins of each structure being received in the bins of the immediately adjacent structure. This reduces the volume required for said structures during storage prior to installation and during transport.

BRIEF DESCRIPTION OF THE DRAWINGS

Embodiments of the invention are described by way of example with reference to the accompanying drawings, in which.

MORE DETAILED DESCRIPTION

Figure 2:
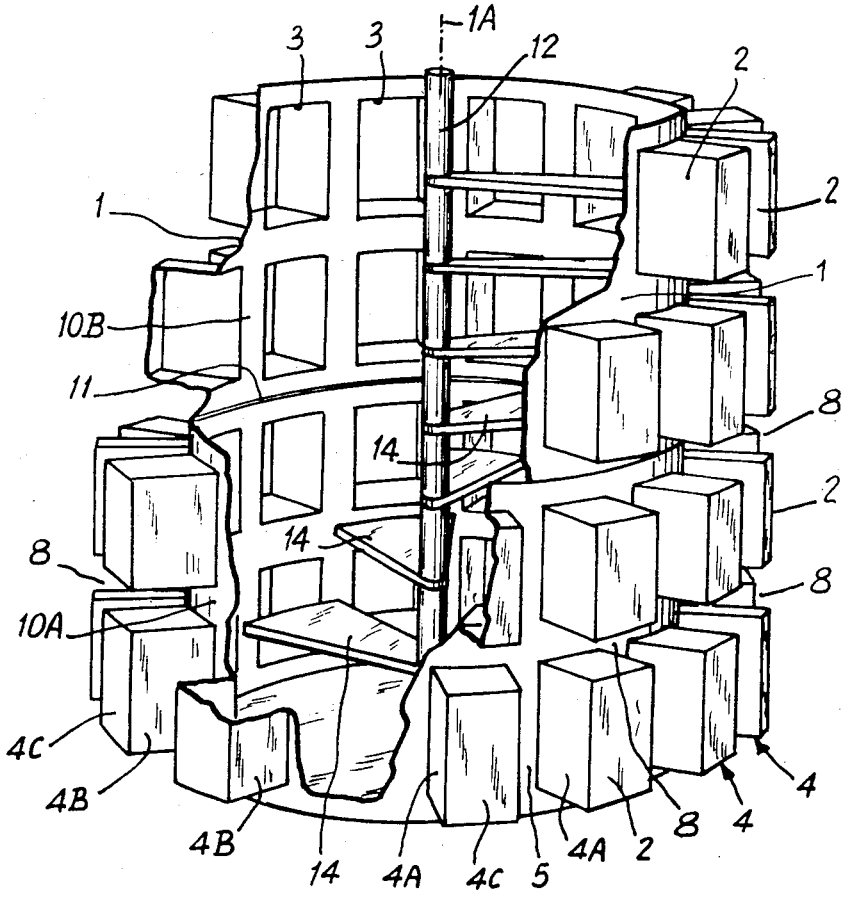
FIG. 2 is a partially cutaway perspective view of a storage bin facility ready for installing in the ground, with the inside of the facility being visible through the cutaway portion.

A structure in accordance with the invention comprises a main wall 1 which, after the structure has been installed, follows a predetermined contour which is generally, but not necessarily circular about a vertical longitudinal axis IA (see FIG. 2). Instead of being circular, the contour may be oval or elliptical, for example, if so desired.

A plurality of bins 2 project outwardly from said main wall 1. Each bin 2 has an opening 3 to the inside face of the main wall 1. Each bin 2 is made by locally deforming the main wall 1 to the desired shape, which is generally rectangular.

The bins 2 are provided along longitudinal lines of the main wall 1 parallel to the axis 1A, such that once the wall has been installed, the bins 2 are aligned in vertical columns 4. Adjacent columns 4 of bins 2 are separated by vertically extending gaps 5 which exist between the longitudinal side walls 4A, 4B of adjacent bins 2. The far ends of the bins are closed by end walls 4C.

Figure 3:
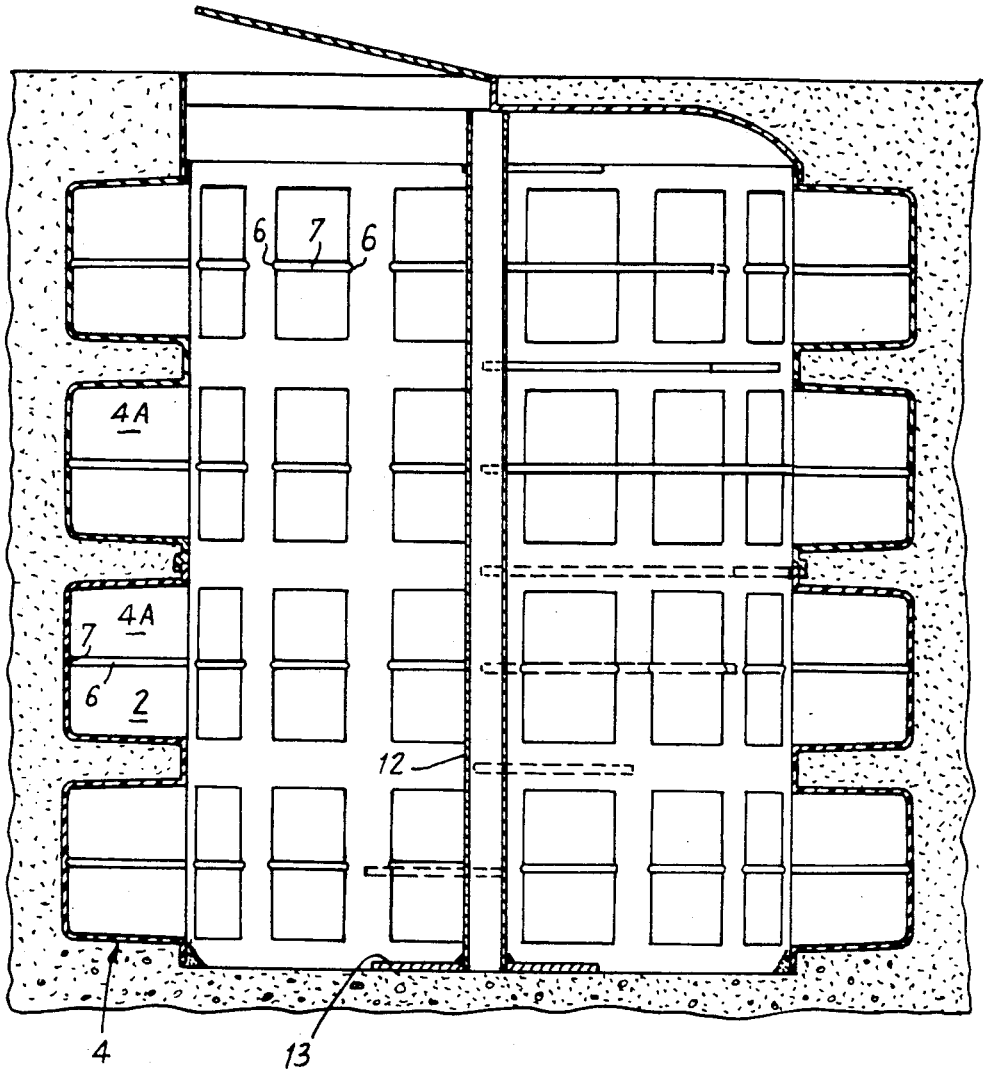
FIG. 3 is a section on a vertical plane passing through the longitudinal axis of a storage facility as shown in FIG. 2, but after it has been installed in the ground.

FIG. 3 shows that grooves 6 may be provided in the vertical longitudinal side walls 4A and 4B and that these grooves 6 may be interconnected by a groove 7 in the far wall 4C. When the structure has been installed, the grooves 6 and 7 are horizontal.

Each column 4 could have its bins 2 immediately adjacent to one another without any gaps, with the bins 2 being separated from vertically adjacent bins by bin-partitioning walls (not shown) slid into the grooves 6 and 7.

However, it is preferable for the bins 2 in each column 4 to be separated by gaps 8 as can be seen in FIG. 2. Each bin 2 thus projects individually from the main wall 1. This has the advantageous results of each bin 2 being surrounded by earth on five of its six faces, with the sixth face being the opening 3 (see FIG. 3). Experience shows that when the vertical gaps 5 between the columns 4 of bins 2 are filled with fine earth or sand, the earth or sand flows into the horizontal gaps 8 between adjacent bins 2 within the columns 4.

The above-described structure may be made in the general finally required shape using any suitable material, for example cement or reinforced concrete. The structure then has a horizontal cross-section which is generally cylindrical or oval and it may be made using a mold which can be taken apart.

Figure 1:
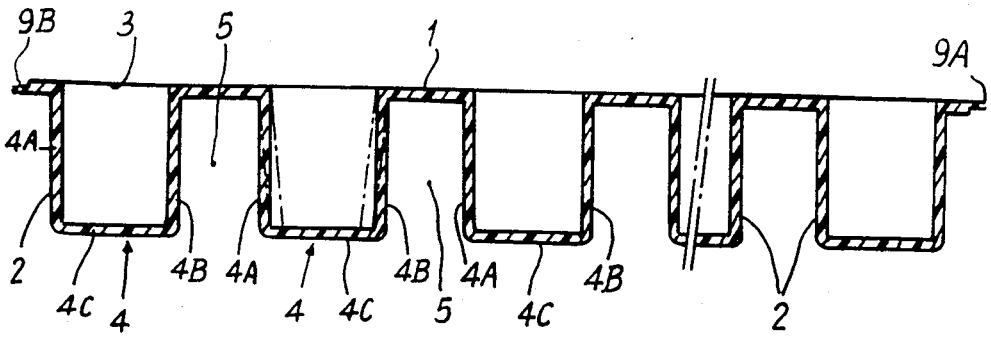
FIG. 1 is a section through a structure made flat in accordance with the method of the invention prior to being installed in an in-ground storage bin facility, in accordance with the invention.

However, in accordance with the invention it is advantageous to make the structure out of a material which is both strong and flexible and to make it in a generally flat or tray-like configuration with all of the bins projecting in the same direction from a common main face, as shown in FIG. 1. The bins 2 may be stamped or formed, for example, in a sheet which is intended to constitute the main wall 1, provided said sheet is made of a noncorrodable material.

Also advantageously, the structure is made in the flat or tray-like configuration by molding glass fiber reinforced polyester. The structure is then easier to store and transport. Each bin 2 has sloping walls to make it easier to unmold.

It is often preferable to accentuate said slope to provide each bin with a tapering cross-section such that its open face 3 is of larger area than its far end face 4C. This is shown in dot dashed lines for one bin only in FIG. 1. Thus, after making a plurality of generally flat structures, they can be stacked by inserting the bins of one structure into the bins of the immediately adjacent structure.

When being installed, the structure is looped on itself by virtue of the flexibility of the main wall 1 in the gaps 5 between columns 4. The two end edges are firmly joined together, either after they have been partially overlapped, or else after overlapping complementary tongues 9A and 9B (see FIG. 1). If the main wall 1 is made of 3 to 4 mm thick there is no difficulty in curving it as required.

A structure in accordance with the invention is preferably made in the form of a strip of limited width, and a plurality of such strips are superposed to obtain a facility of the desired depth. FIG. 2 shows two such strips 10A and lOB which are superposed along a horizontal join plane 11. The longitudinal edges of the strips which come into contact in said join plane 11 are provided with complementary assembly means.

In order to construct a storage facility in the ground, a hole of sufficient size is dug and the bottom is consolidated by making a bed of compacted sand or of concrete. The bottom is to support a central pole 12 made of steel and fitted with a bearing plate 13 at its bottom end. A spiral of steps 14 are fixed firmly to the pole 12, e.g. by welding. The steps 14 extend radially and come into contact with the inside face of the main wall 1. The free end of each step 14 is wider than the corresponding width of the bins 2. The geometric axis of the pole 12 is the same as the vertical longitudinal axis 1A of the assembled structure and of its main wall 1.

We claim:

1. A structure for an in-ground storage facility comprising a main wall extending around an incurvated closed perimeter about a longitudinal axis and a plurality of storage bins which project radially outward from said main wall with respective openings in said wall so that at least five walls of said storage bins are in contact with the ground, said bins being spaced apart from one another at least by longitudinally extending gaps, said structure further comprising a one piece strong, flexible member for being made as a generally flat structure having two opposite longitudinal end edges and being subsequently curved to follow said incurvated closed perimeter with said end edges being securely fastened together.

2. A structure according to claim 1, wherein said bins run together vertically to constitute outwardly projecting columns in the installed structure, said columns being separated by said vertically extending gaps, and said bins including grooves at least in facing side walls thereof to receive bin-partitioning walls to separate the bins from one another in the vertical direction.

3. A structure according to claim 1, wherein the bins are aligned along longitudinal lines of the main wall to constitute outwardly projecting columns which extend vertically after installation, said columns being separated by said gaps, and the bins within said columns being separated from one another by horizontally extending gaps.

4. A structure according to claim 3, wherein grooves are provided in facing side walls of said bins and preferably also in the far end walls of said bins, thereby enabling a bin-partitioning wall to be slid into each bin.

5. A structure according to claim 1, installed around a spiral staircase having a central pole with steps projecting radially therefrom to come into contact with the inside face of the main wall, the circumferential extent of the ends of said steps being greater than the corresponding extent of the bins.

6. A structure according to claim 1, wherein the main wall is made as a generally flat tray-like structure with the bins projecting from one of the main faces thereof, which wall is subsequently curved to follow a desired perimeter with its end edges being securely fastened together.

7. A stucture according to claim 6, wherein the main wall and its bins are made by molding reinforced polyester, with said bins being provided with a taper suitable for facilitating unmolding.

8. A structure according to claim 7, wherein said bins are provided with an accentuated taper suitable for enabling the bins of one structure to be received in the bins of another, thereby enabling said structures to be stacked for storage and transport.

9. A structure according to claim 6, wherein the structure is made in strips which are superposed and securely fastened together in join planes when installing an in-ground facility.

* * * * *